US005816068A

United States Patent [19]

Oh et al.

[11] Patent Number: 5,816,068

[45] Date of Patent: Oct. 6, 1998

[54] SEPARATE-TYPE REFRIGERATOR

[75] Inventors: Gil Soo Oh, Suwon; Jae Ok Sim, Kunpo, both of Rep. of Korea

[73] Assignee: Samsung Electronics Co., Ltd., Suwon, Rep. of Korea

[21] Appl. No.: 897,697

[22] Filed: Jul. 21, 1997

[30] Foreign Application Priority Data

Jul. 30, 1996 [KR] Rep. of Korea ..... 1996 31598

[51] Int. Cl.[6] ..... F25D 17/04

[52] U.S. Cl. ..... 62/407; 62/441

[58] Field of Search ..... 62/255, 404, 407, 62/408, 414, 415, 419, 426, 440, 441

[56] References Cited

U.S. PATENT DOCUMENTS 3,403,533 10/1968 Bollenbacher ..... 62/441
3,477,243 11/1969 Schroeder ..... 62/407

*Primary Examiner*—John M. Sollecito

*Attorney, Agent, or Firm*—Burns, Doane, Swecker & Mathis, L.L.P.

[57] ABSTRACT

A separate-type refrigerator is provided. The refrigerator comprises: a cooling system having a compressor, a condenser and an evaporator for generating cool air, the evaporator having a first evaporating portion and a second evaporating portion which are arranged in series; a main cabinet for forming a main storage room; an auxiliary cabinet installed adjacent to the main cabinet, being spaced from the main cabinet by a predetermined distance, for forming an auxiliary storage room, so that the cool air communicates between the main storage room of the main cabinet and the auxiliary storage room of the auxiliary cabinet; a main fan installed inside the main cabinet, for transferring the cool air from the first evaporating portion to the main storage room of the main cabinet; and an auxiliary fan installed inside the main cabinet, for transferring the cool air from the second evaporating portion to the auxiliary storage room of the auxiliary cabinet. Accordingly, the cool air can be suitably and independently distributed to the main and auxiliary storage rooms.

3 Claims, 3 Drawing Sheets

SEPARATE-TYPE REFRIGERATOR

BACKGROUND OF THE INVENTION

The present invention relates to a separate-type refrigerator having a main cabinet and an auxiliary cabinet which is separately installed to the main cabinet, and more particularly, to a separate-type refrigerator in which cool air can be suitably distributed in the main cabinet and the auxiliary cabinet.

A refrigerator generally includes a cabinet in which food storage rooms are formed and a cooling system installed inside the cabinet to supply cool air to the food storage rooms. The food storage rooms are typically classified into a freezing room and a refrigerating room of which cooling temperatures are different from each other, thereby meeting the characteristics of various foods to be stored therein. Recently, the refrigerator tends to be large-sized according to a need for large storage rooms, but the increase of the whole size thereof is limited in view of a manufacturing, a transportation, an installation or a changeability thereof. Hence, a separate-type refrigerator has been developed, in which an auxiliary cabinet forming an auxiliary storage room is separately attached to a main cabinet forming a main storage room and the cool air can be communicated between the main storage room and the auxiliary storage room. This separate-type refrigerator has advantages in that large storage rooms can be easily secured and the manufacturing, transportation, installation and changeability problems can be easily solved.

In such a separate-type refrigerator, the main and auxiliary cabinets are adjacently installed, being spaced from each other by a predetermined distance, and the auxiliary storage room of the auxiliary cabinet receives the cool air directly from a cooling system which is installed inside the main cabinet or through the main storage room. The cool air which has circulated inside the auxiliary storage room returns to an evaporator of the cooling system or the main storage room. Generally, the main storage room receives the cool air directly from the evaporator and is used as a freezing room, while the auxiliary storage room is used as a refrigerating room.

The cool air is transferred to the main storage room and the auxiliary storage room by means of a pair of fans which are installed inside the main cabinet. The pair of fans are arranged so as to transfer the cool air from the evaporator to the opposite directions.

However, since two fans independently transfers the cool air from one evaporator to the respective storage rooms, when a cooling temperature of one storage room is lowered or raised, a cooling temperature of the other storage room can be over-raised or over-lowered. That is, it is difficult to control the cooling temperatures of the respective storage rooms independently.

SUMMARY OF THE INVENTION

It is an object of the present invention to provide a separate-type refrigerator in which cool air is suitably distributed in a main storage room and an auxiliary storage room, thereby independently controlling cooling temperatures of the main and auxiliary storage rooms.

To accomplish the above object, there is provided a separate-type refrigerator comprising:

a cooling system having a compressor, a condenser and an evaporator for generating cool air, the evaporator having a first evaporating portion and a second evaporating portion which are arranged in series;

a main cabinet for forming a main storage room;

an auxiliary cabinet installed adjacent to the main cabinet, being spaced from the main cabinet by a predetermined distance, for forming an auxiliary storage room, so that the cool air communicates between the main storage room of the main cabinet and the auxiliary storage room of the auxiliary cabinet;

a main fan installed inside the main cabinet, for transferring the cool air from the first evaporating portion to the main storage room of the main cabinet; and an auxiliary fan installed inside the main cabinet, for transferring the cool air from the second evaporating portion to the auxiliary storage room of the auxiliary cabinet.

It is preferable that the refrigerator further comprises a separating plate installed between the first and second evaporating portions of the evaporator and an evaporator cover installed between the evaporator and the main storage room of the main cabinet, wherein the separating plate is attached to the evaporator cover.

BRIEF DESCRIPTION OF THE DRAWINGS

The above object and advantage of the present invention will become apparent by describing in detail a preferred embodiment thereof with reference to the accompanying drawings in which.

DETAILED DESCRIPTION OF THE INVENTION

Figure 1:
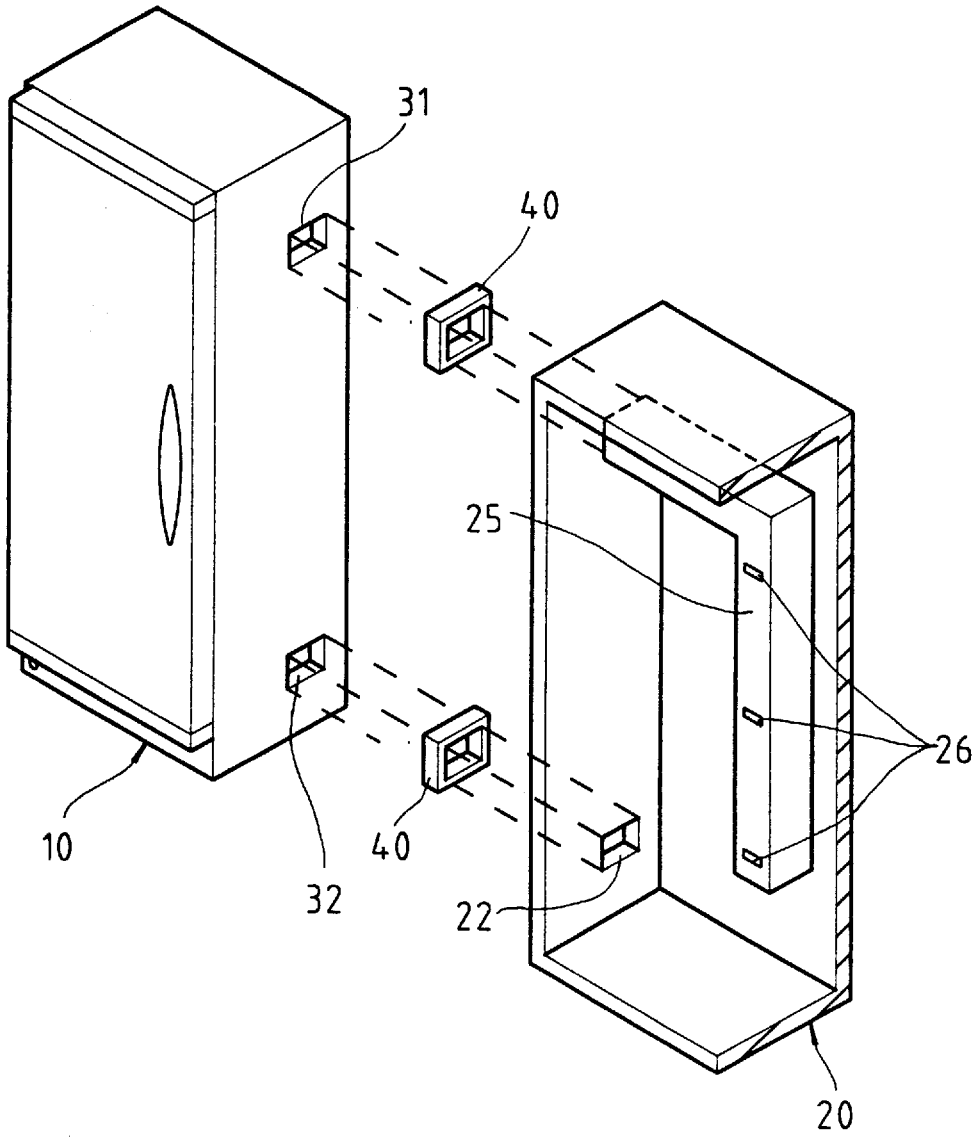
FIG. 1 schematically shows an exploded perspective view of a separate-type refrigerator according to the present invention.
Figure 2:
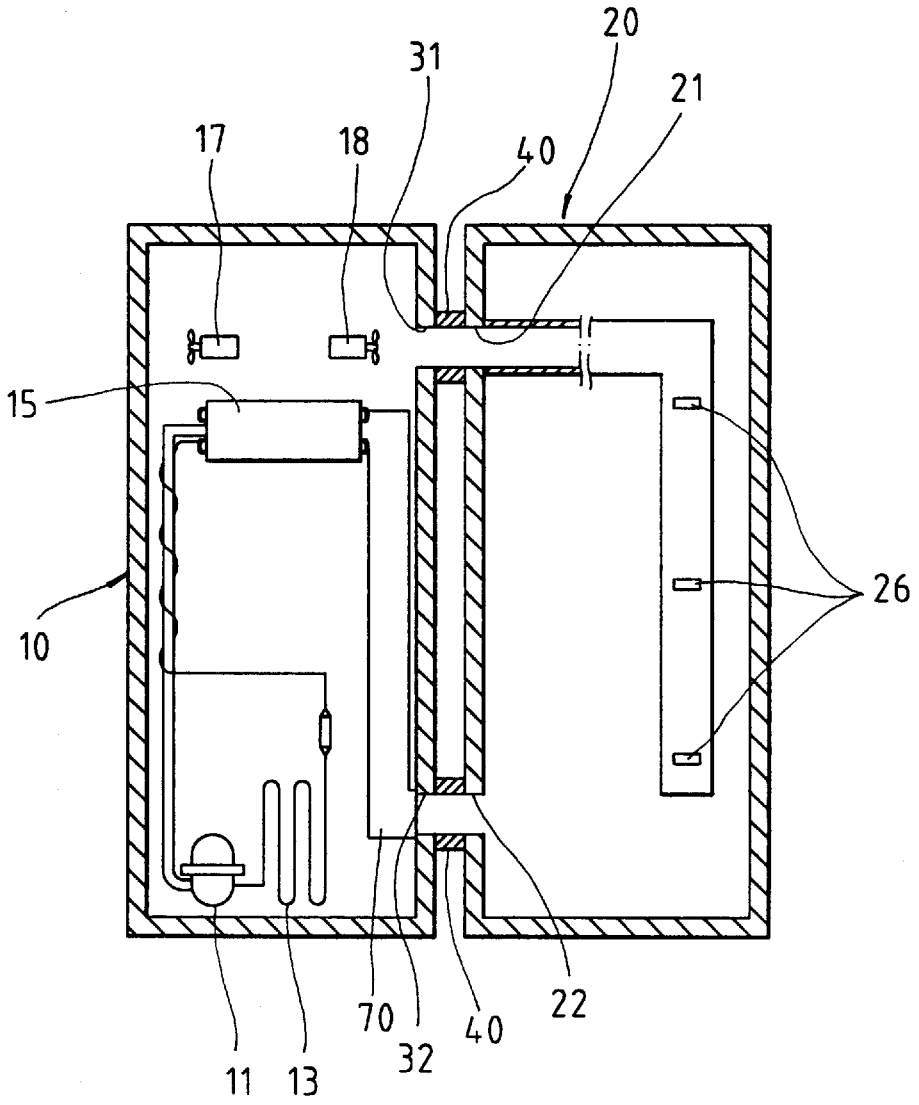
FIG. 2 shows a schematic sectional view of the separate-type refrigerator according to the present invention.

Referring to FIGS. 1 and 2, a separate-type refrigerator according to the present invention includes a main cabinet 10 forming a main storage room and an auxiliary cabinet 20 forming an auxiliary storage room and which is installed adjacent to the main cabinet 10. The main and auxiliary cabinets 10 and 20 are spaced from each other by a predetermined distance.

The main cabinet 10 is provided with a cooling system having a compressor 11, a condenser 13 and an evaporator 15 for generating cool air. The evaporator 15 of the cooling system is installed at an upper portion of the main cabinet 10 to supply the cool air to the main storage room of the main cabinet 10. The compressor 11 and the condenser 13 are installed at a lower portion of the main cabinet 10, being separated from the main storage room of the main cabinet 10.

As shown in FIG. 2, the main cabinet 10 is formed with a cool air supplying port 31 and a cool air recovering port 32 at upper and lower portions of a wall thereof which faces the auxiliary cabinet 20. The auxiliary cabinet 20 is formed with a cool air receiving port 21 and a cool air discharging port 22 at upper and lower portions of a wall thereof which faces the main cabinet 10, corresponding to the cool air supplying and recovering ports 31 and 32 of the main cabinet 10. The cool air which is generated by the evaporator 15 flows through the cool air supplying port 31 of the main cabinet 10 and the cool air receiving port 21 of the auxiliary cabinet 20 into the auxiliary storage room of the auxiliary cabinet 20. After circulating inside the auxiliary storage room of the auxiliary cabinet 20, the cool air returns to the main cabinet 10 through the cool air discharging port 22 of the auxiliary cabinet 20 and the cool air recovering port 32 of the main cabinet 10. The cool air returning to the main cabinet 10 is transferred to the evaporator 15 through a recovery duct 70 which is installed inside the main cabinet 10. Sealing members 40 are installed between the cool air supplying and receiving ports 31 and 21 and between the cool air discharging and recovering ports 22 and 32, respectively, to perform sealing functions between the ports 31 and 21 and the ports 22 and 32.

A main fan 17 and an auxiliary fan 18 are installed above the evaporator 15. The main fan 17 functions to transfer the cool air from the evaporator 15 to the main storage room of the main cabinet 10, whereas the auxiliary fan 18 functions to transfer the cool air from the evaporator 15 to the auxiliary storage room of the auxiliary cabinet 20 through the cool air supplying and receiving ports 31 and 21. The cool air transferred into the auxiliary storage room of the auxiliary cabinet 20 flows along a cool air duct 25 which is installed inside the auxiliary cabinet 20 and is distributed into the auxiliary storage room through cool air distributing holes 26 formed at the cool air duct 25.

In the above-described refrigerator, the main storage room of the main cabinet 10 receives the cool air directly from the evaporator 15 and therefore is used as the freezing room, whereas the auxiliary storage room of the auxiliary cabinet 20 receives a relatively small amount of cool air and therefore is used as the refrigerating room.

Figure 3:
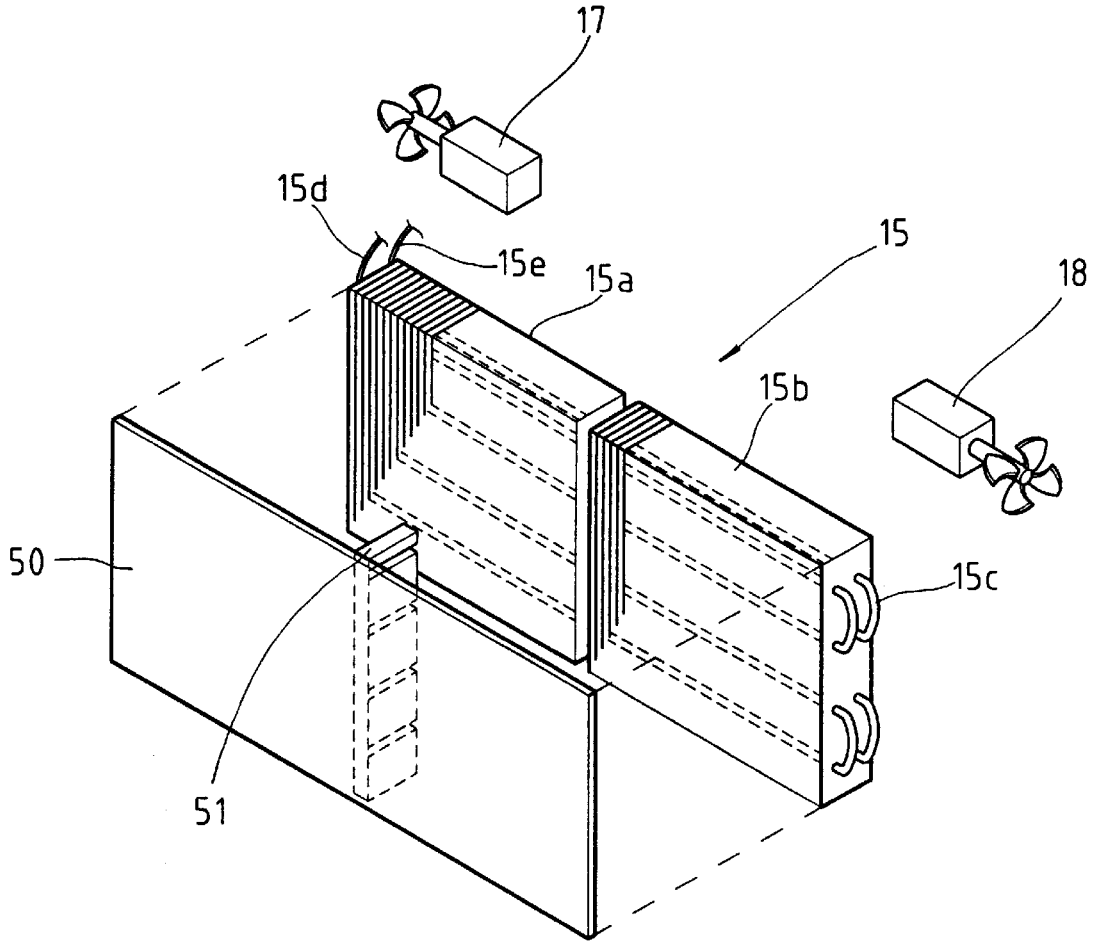
FIG. 3 shows an exploded perspective view of an evaporator.

Referring to FIG. 3, the evaporator 15 includes a first and second evaporating portions 15*a* and 15*b* which are spaced from each other by a predetermined distance. The evaporating portions 15*a* and 15*b* include a heat-transferring tube 15*c* and a multiplicity of radiating fins which are arranged perpendicularly to the heat-transferring tube 15*c*. The inlet and outlet sides of the heat-transferring tube 15*c* are connected to an inlet tube 15*d* and an outlet tube 15*e*, respectively. A refrigerant transferred through the inlet tube 15*d* is vaporized while flowing the heat-transferring tube 15*c* and transferred to the compressor 11 through the outlet tube 15*e*.

An evaporator cover 50 is installed on the front of the evaporator 15, which faces the main storage room of the main cabinet 10 to prevent the cool air from the evaporator 15 from directly contacting foods inside the main storage room. A separating plate 51 is attached to the center of the evaporator cover 50, perpendicular to the plane of the cover 50. The separating plate 51 is inserted between the two evaporating portions 15*a* and 15*b* to isolate the evaporating portions 15*a* and 15*b*. The separating plate 51 is formed with a plurality of slits 51*a* to receive the heat-transferring tube 15*c* without interference.

In the above-structured refrigerator, the cool air which is generated by the first evaporating portion 15*a* is transferred to the main storage room of the main cabinet 10 by the main fan 17, whereas the cool air which is generated by the second evaporating portion 15*b* is transferred to the auxiliary storage room the auxiliary cabinet 20 by the auxiliary fan 18 through the cool air plying and receiving ports 31 and 21. Thus, the cool air can be pendently transferred to the respective storage rooms by the separate fans and 18 from the separate evaporating portions 15*a* and 15*b* to prevent supply or undersupply of the cool air to the respective storage rooms, so cooling temperatures of the respective storage rooms can be independently easily controlled.

As described above, according to the separate-type refrigerator of the present invention, the cool air can be suitably and independently distributed to main and auxiliary storage rooms.

What is claimed is:

1. A separate-type refrigerator comprising:

a cooling system having a compressor, a condenser and an evaporator for generating cool air, said evaporator having a first evaporating portion and a second evaporating portion which are arranged in series;

a main cabinet for forming a main storage room;

an auxiliary cabinet installed adjacent to said main cabinet, being spaced from said main cabinet by a predetermined distance, for forming an auxiliary storage room, so that the cool air communicates between the main storage room of said main cabinet and the auxiliary storage room of said auxiliary cabinet;

a main fan installed inside said main cabinet, for transferring the cool air from the first evaporating portion to the main storage room of said main cabinet; and an auxiliary fan installed inside said main cabinet, for transferring the cool air from said second evaporating portion to the auxiliary storage room of said auxiliary cabinet.

2. A separate-type refrigerator as claimed in claim 1, further comprising a separating plate installed between said first and second evaporating portions of said evaporator.

3. A separate-type refrigerator as claimed in claim 2, further comprising an evaporator cover installed between said evaporator and the main storage room of said main cabinet, wherein said separating plate is attached to said evaporator cover.

* * * * *